US006499182B2

(12) United States Patent
Berfield et al.

(10) Patent No.: US 6,499,182 B2
(45) Date of Patent: Dec. 31, 2002

(54) CONVERTIBLE BLOWER PORT FOR VACUUM CLEANER

(75) Inventors: Robert C. Berfield, Jersey Shore, PA (US); Ronald Griffin, Williamsport, PA (US); Kevin Fry, South Williamsport, PA (US); Randy L. Buss, Hughesville, PA (US)

(73) Assignee: Shop-Vac Corporation, Williamsport, PA (US)

( * ) Notice: Subject to any disclaimer, the term of this patent is extended or adjusted under 35 U.S.C. 154(b) by 0 days.

(21) Appl. No.: 09/867,069

(22) Filed: May 29, 2001

(65) Prior Publication Data

US 2002/0178533 A1 Dec. 5, 2002

(51) Int. Cl.[7] ..... A47L 5/14
(52) U.S. Cl. ..... 15/330; 15/337; 15/405
(58) Field of Search ..... 15/405, 330, 337

(56) References Cited

U.S. PATENT DOCUMENTS

| | | | | | |
|---|---|---|---|---|---|
| 2,027,158 | A | | 1/1936 | Forsberg | |
| 2,232,906 | A | | 2/1941 | Ernolf | |
| 2,597,690 | A | * | 5/1952 | Wied | 15/330 |
| 2,598,499 | A | * | 5/1952 | Breuer et al. | 15/329 |
| 2,751,038 | A | | 6/1956 | Acheson | |
| 2,754,048 | A | | 7/1956 | Hansen | |
| 2,757,753 | A | | 8/1956 | Kasper | |
| 2,788,936 | A | | 4/1957 | Kemnitz | |
| 2,905,267 | A | | 9/1959 | Thompson | |
| 2,959,804 | A | | 11/1960 | Faber | |
| 2,974,343 | A | | 3/1961 | Seyfried | |
| 2,986,765 | A | | 6/1961 | Ernolf et al. | |
| 3,032,955 | A | * | 5/1962 | Burch | 15/330 |
| 3,524,211 | A | | 8/1970 | Wolf | |
| 3,924,291 | A | | 12/1975 | Tschudy et al. | |
| 4,225,999 | A | * | 10/1980 | Martinec et al. | 15/330 |
| 4,325,163 | A | | 4/1982 | Mattson et al. | |
| 4,674,146 | A | | 6/1987 | Tuggle et al. | |
| 4,683,608 | A | | 8/1987 | Berfield et al. | |
| 4,694,528 | A | | 9/1987 | Comer et al. | |
| 5,003,662 | A | | 4/1991 | Everts | |
| 5,060,339 | A | * | 10/1991 | Evers | 15/246 |
| 5,349,721 | A | | 9/1994 | Iida | |
| 5,477,588 | A | | 12/1995 | Iida et al. | |
| 5,560,078 | A | | 10/1996 | Toensing et al. | |
| 5,638,574 | A | * | 6/1997 | Haupt et al. | 15/330 |
| 5,689,852 | A | | 11/1997 | Svoboda et al. | |
| 5,711,048 | A | | 1/1998 | Pink et al. | |
| 5,819,368 | A | * | 10/1998 | Wang et al. | 15/337 |
| 6,295,693 | B1 | * | 10/2001 | Chou | 141/66 |
| 6,309,469 | B2 | * | 10/2001 | Storrs et al. | 134/21 |

* cited by examiner

*Primary Examiner*—Chris K. Moore
(74) *Attorney, Agent, or Firm*—Marshall, Gerstein & Borun

(57) ABSTRACT

A convertible blower port for a vacuum cleaner includes a cylindrical port wall carried by a portion of a vacuum cleaner. The port wall has a first end facing inwardly toward the vacuum cleaner and a second end opposite the first end. The port wall defines a blower passage in communication with the plenum of the vacuum cleaner. A blower port outlet is provided on the second end of the port wall. A removable cap closes off the blower port outlet and has an exterior surface for gripping the cap and has a hub configured to fill the blower passage. The hub has a substantially smooth inner end face that is positioned generally across the first end of the port wall and faces the plenum of the vacuum cleaner.

21 Claims, 7 Drawing Sheets

24
10

31
22
13
14
41
39
34
36
38
42
16
40
36
38
40
34
39
42
41
100
104
74
66
50
68
102
110
60
72
30
62
110
54
70
64
20
74
68
52
28

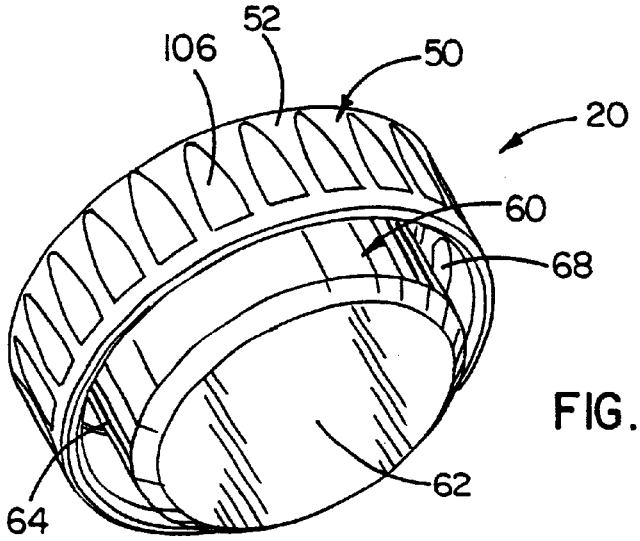
FIG. 5
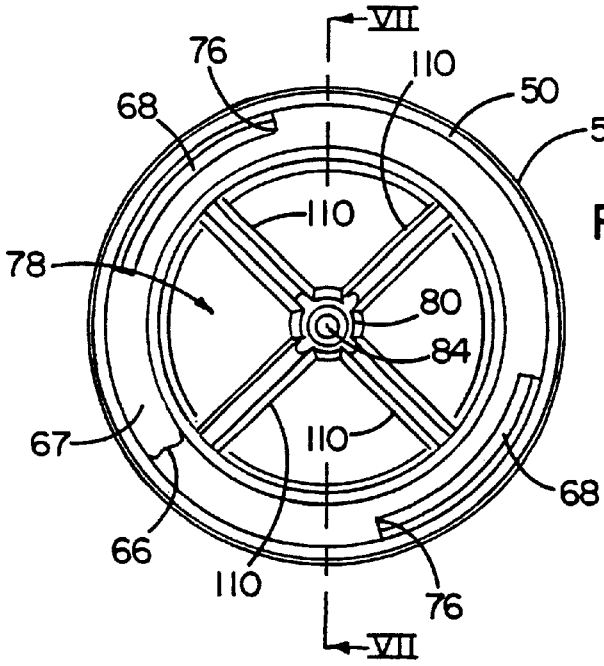
FIG. 6
FIG. 7
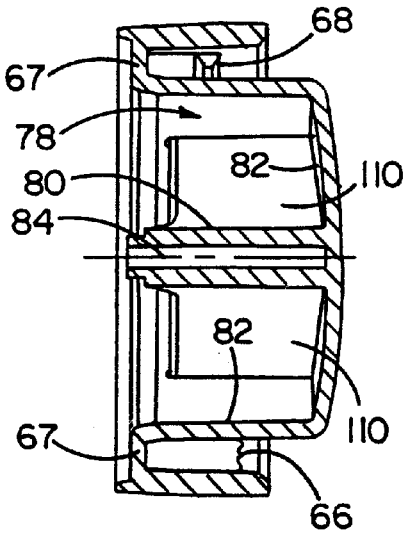

CONVERTIBLE BLOWER PORT FOR VACUUM CLEANER

FIELD OF THE INVENTION

The present invention relates generally to vacuum cleaner blower ports, and more particularly to a removable cap for a blower port of a vacuum cleaner that closes off the blower port when not used as a blower and that reduces noise generated at the blower port.

BACKGROUND OF THE INVENTION

Typical wet/dry vacuum cleaners have a tank and a motor housing supported by the tank. A motor is disposed within the housing and has an impeller that, when operating, draws air or creates a vacuum at a vacuum port of the housing. Air is exhausted through a blower port of the housing. When utilized as a blower, the hose is attached to the blower port whereby air is forced through the port and the vacuum hose, exiting a nozzle end of the hose. When the vacuum cleaner is used as a suction vacuum, the hose is attached to the vacuum port which leaves the blower port open.

A conventional wet/dry vacuum cleaner motor creates a relatively high decibel, high pitch noise when operating as a vacuum. A significant amount of the noise is generated by turbulent flow of air exiting the blower port. The blower port communicates with an interior plenum of the motor housing wherein air is forced by the motor into the plenum and out the blower port.

Attempts have been made to reduce the noise of a wet/dry vacuum cleaner that is generated via the blower port. For example, the motor housing can be provided with a plurality of vent openings spaced along the motor housing that each communicate with the plenum of the motor housing. The blower port is closed by a plug or a cap such that air cannot exit the blower port when the vacuum is used as a suction vacuum cleaner. Instead, the air exits the plenum via the plurality of vents. By incorporating one or more vents and spacing them along the plenum, air within the plenum is distributed and dispersed, exiting the plenum at lower velocity, reducing noise generated by the vacuum. The air is redirected through larger volume spaces and thus expanded. The expansion and redirection of the air muffles sound generated by the flow of air within the plenum.

U.S. Pat. No. 2,757,753 discloses an interior spring biased shutter valve that automatically closes off the blower port when a vacuum cleaner is used as a conventional vacuum permitting air to exit the vacuum housing through a plurality of vents or ports. Insertion of a hose into the blower port opens the shutter valve permitting the vacuum to be used as a blower.

U.S. Pat. No. 2,959,804 discloses a vacuum with a blower port having a spring biased cover that is in the closed position when the vacuum is used as a vacuum. A cover plate deflects air exiting the vacuum to a high-volume opening instead of through the blower opening.

U.S. Pat. No. 2,986,765 discloses utilizing a removable cap similar to a coffee can lid that is moved from the vacuum port to the inlet port depending upon the particular use of the vacuum cleaner. The disclosed vacuum cleaner has a third opening at the top of the vacuum for admitting or exhausting air from the body of the vacuum, depending on its use.

U.S. Pat. No. 5,003,662 discloses a lid for a convertible blower/vacuum wherein the lid is connected via a hinge to a port of the vacuum and is biased by a spring to a closed position over the port. The lid is held open when a hose is inserted in the port.

A number of problems and deficiencies exist with these types of blower port covers. A permanently connected, spring biased, hinged lid requires a number of separate components such as a hinge pin or pins, hinge bearing surfaces, and a bias spring in order to form the hinge of the types described above. In addition, the mold utilized to make the lid can be relatively expensive and complicated because of the non-symmetrical and precision mold features necessary to form the hinge bearing surfaces which require fairly precise manufacturing control. Another problem with these devices is that, once the spring or the bearing surface breaks, the lid will no longer function properly unless the components are replaced. If the lid is internally mounted within the housing, this can be a fairly difficult and expensive process.

A problem with lids that are not attached to the vacuum cleaner is that they can easily become lost or misplaced. Once lost, the user must purchase another lid or will simply utilize the vacuum without the lid, eliminating the benefits of having the lid. In addition, if the lid is not properly designed, noise may be created by turbulent air flow inside a chamber that is closed by the lid.

SUMMARY OF THE INVENTION

Objects, features, and advantages of the present invention will become apparent upon a review of the examples herein and the accompanying drawing figures. In one example constructed according to the teachings of the present invention, a convertible blower port for a vacuum cleaner has a cylindrical port wall carried by a portion of the vacuum cleaner. The port wall has a first end facing inwardly toward the vacuum cleaner and a second end opposite the first end. The port wall defines a blower passage in communication with a plenum section of the vacuum cleaner. A blower port outlet is provided on the second end of the port wall. A removable cap closes off the blower port outlet and has an exterior surface adapted for gripping the cap and further has a hub configured to fill the blower passage. The hub has a substantially smooth inner end face positioned generally across the first end of the port wall and facing the plenum of the vacuum cleaner.

In one example, a tether is provided connecting the cap and a portion of the vacuum cleaner so that the cap can be secured over the blower port outlet or suspended from the tether when removed from the outlet.

In one example, the port wall extends outward from the vacuum cleaner around the blower port such that the first end is connected to the vacuum cleaner and the second end and the blower port outlet are spaced from the vacuum cleaner.

In one example, at least one mechanical thread is provided on the port wall and at least one corresponding mechanical thread is provided on a portion of the cap for removably securing the cap to the blower port.

In one example, the cap of the blower port includes an annular cap wall defining a cap center axis and having an exterior cap wall surface that defines the exterior cap gripping surface. The cap wall also has a generally cylindrical interior cap wall surface. An exterior annular hub surface is spaced radially inward from the interior annular wall surface to define a gap between the hub and the annular cap wall. At least a portion of the port wall is received in the gap when the cap is installed over the blower port.

In one example, at least one mechanical thread is provided on an exterior surface of the port wall and at least one corresponding mechanical thread is provided on the interior surface of the cap wall for removably securing the cap to the blower port.

In one example, the exterior surface of the annular cap wall is generally cylindrical and includes a plurality of grip assist features provided thereon.

In one example of the present invention, a cap is provided for selectively closing off a blower port of a vacuum cleaner. The cap has an annular wall defining a central cap axis and has an inwardly facing end, an outwardly facing end, an exterior wall surface, and a generally cylindrical interior wall surface. An outer cap end face faces in the direction of the outwardly facing end of the cap wall. A cylindrical hub is disposed concentric with the cap axis and has an exterior annular hub surface spaced radially inward from the interior wall surface. A substantially smooth inner cap end face is carried on one end of the hub and faces in the direction of the inwardly facing end of the cap wall. A tether extends from a portion of the cap for attachment to the vacuum cleaner.

In one example, the outer cap end face is provided on a cap cover plate removably secured to a portion of the cap.

In one example, a blind bore is provided concentric with the cap axis and is carried by a portion of the hub. A cap cover plate has a center opening and a surface that defines the outer cap end face. A fastener is received through the cover plate opening and within the blind bore to secure the cap cover plate to the cap.

In one example, the hub of the cap has an interior recess that defines a concave surface within the hub that faces opposite the inner cap end face. An axial post extends from the concave surface within the recess and defines the blind bore. A plurality of ribs extend radially from the post and interconnect the post to the concave surface of the hub. The cap cover plate covers the recess when attached to the cap.

In one example, the center opening in the cap cover plate includes a recessed sink portion permitting a head of a fastener to seat flush with or recessed into the outer cap end face.

In one example, the outer cap end face is a separate discrete component secured to the cap.

In one example, the hub and the annular wall are provided as a unitary one-piece structure.

In one example, the hub and the annular wall are molded from a plastic material.

In one example, one end of the tether is integrally formed as a portion of the cap. In another example, the outer cap end face is provided on a molded plastic cap cover plate that is removably secured to a portion of the cap. One end of the tether is integrally molded as a portion of the cap cover plate.

In one example of the invention, a vacuum cleaner has a tank, a motor assembly supported by a portion of the tank, and a motor and motor housing included as parts of the motor assembly. The vacuum cleaner also includes a convertible blower port as described above.

Objects, features, and advantages of the present invention are inherent in the cap, blower port, and vacuum cleaner claimed and disclosed herein. These and other objects, features and advantages will become apparent to those of ordinary skill in the art from the following detailed description in conjunction with the accompanying drawings.

BRIEF DESCRIPTION OF THE DRAWINGS

FIG. 5 is a perspective view of the cap shown in FIGS. 1–4.

FIG. 6 is an outer end view of a portion of the cap shown in FIGS. 1–4, but with a cap cover plate removed.

FIG. 7 is a sectional view taken along the line VII—VII of FIG. 6 of the cap portion.

DESCRIPTION OF THE PREFERRED EMBODIMENTS

Figure 1:
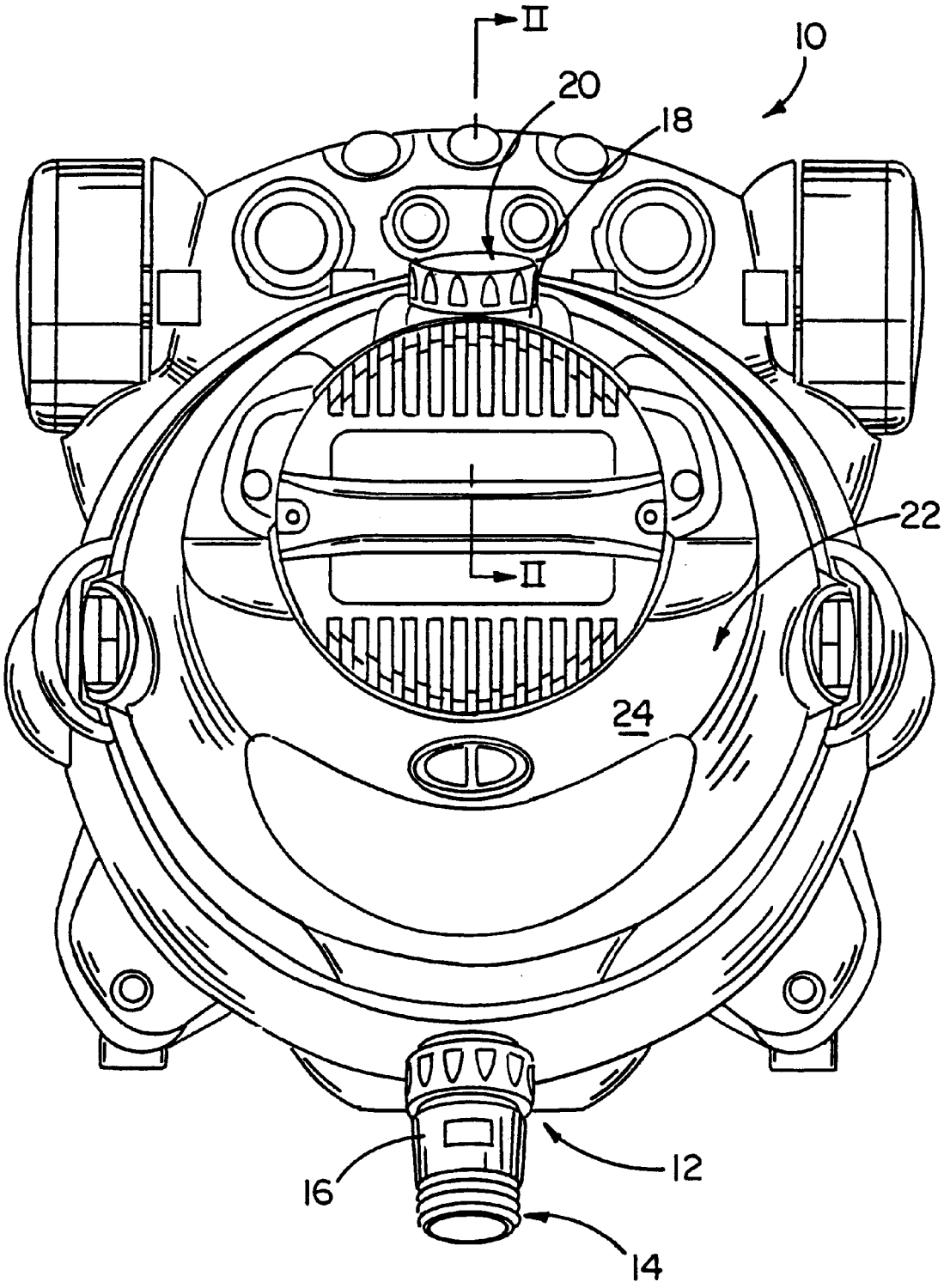
FIG. 1 is a top simplified view of a vacuum cleaner constructed according to the teachings of the present invention.
Figure 2:
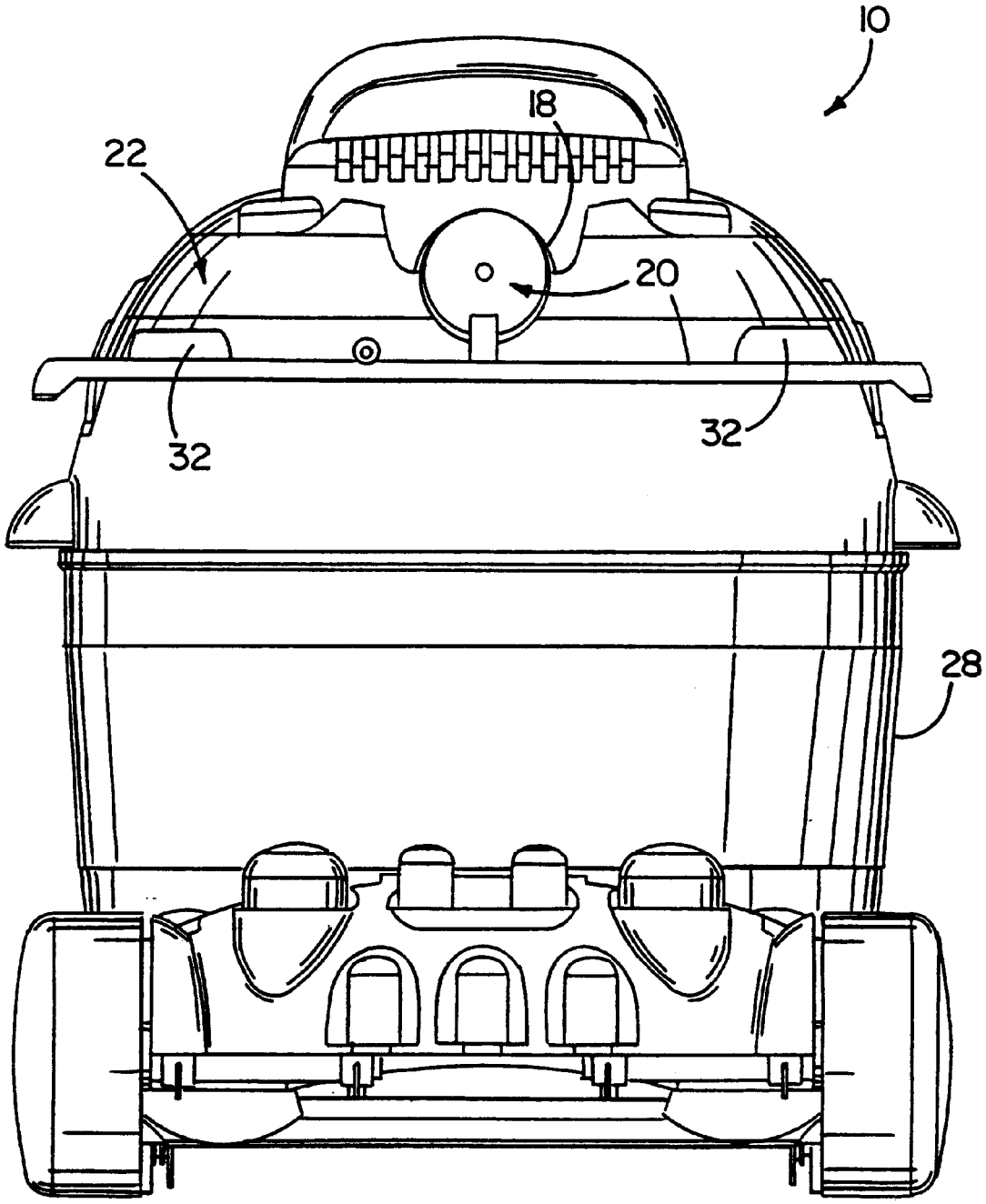
FIG. 2 is a rear view of the vacuum cleaner shown in FIG. 1 and illustrating a blower port and cap assembly constructed according to the teachings of the present invention.
Figure 3:
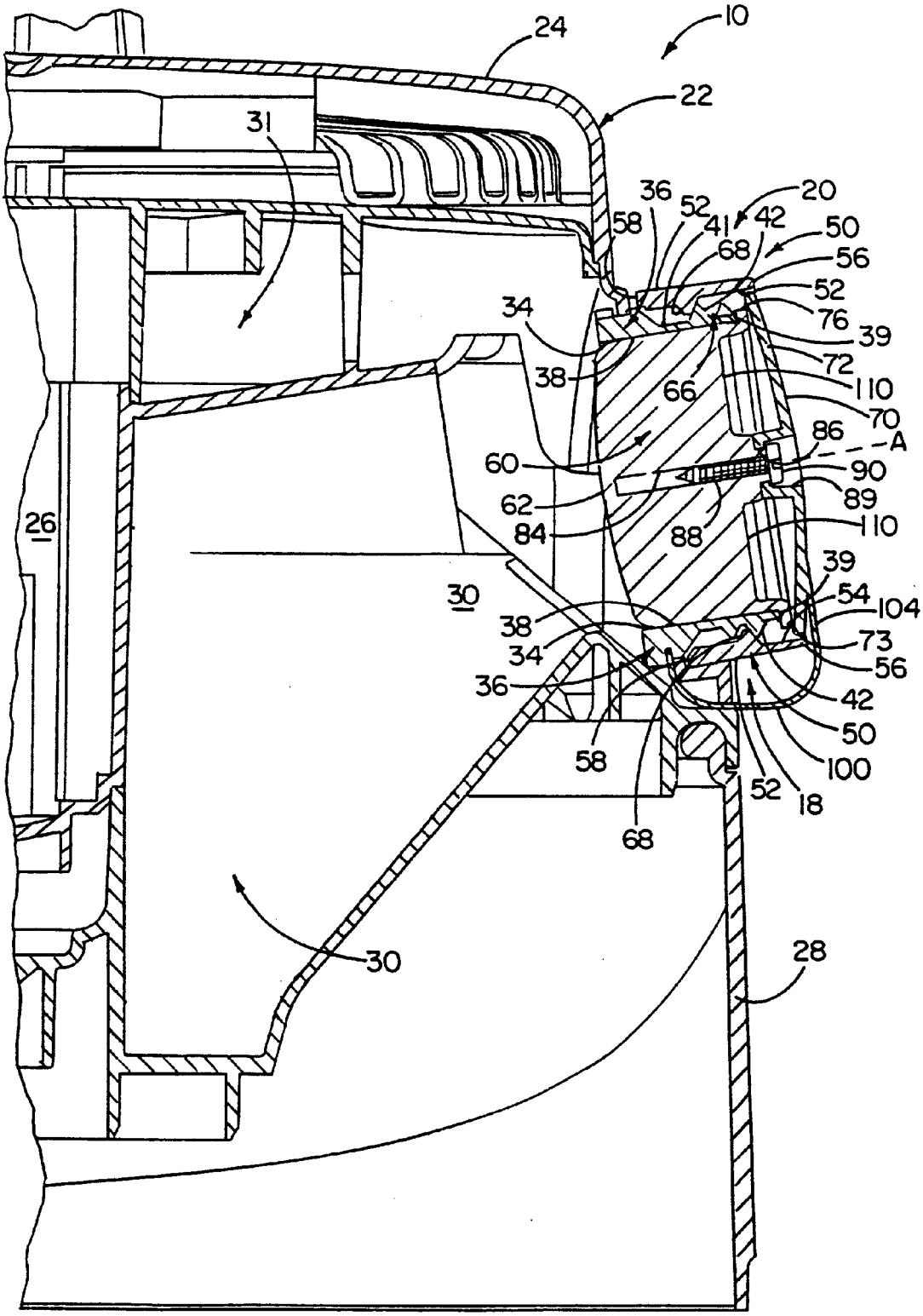
FIG. 3 is side sectional view of a portion of the vacuum cleaner taken along line III—III in FIG. 1 and including a closed blower port and cap assembly according to the teachings of the present invention.
Figure 4:
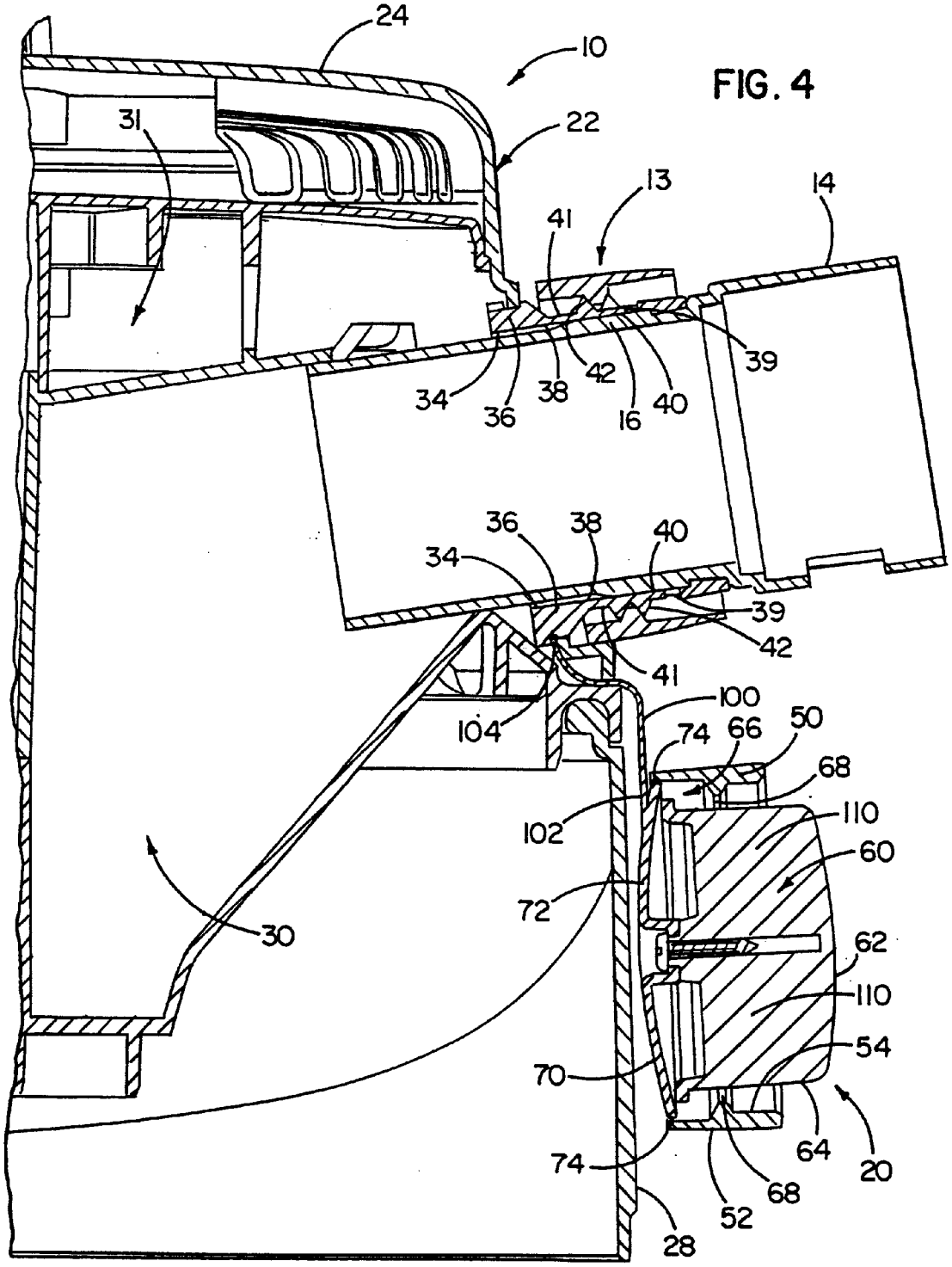
FIG. 4 is a side sectional view of the same portion as in FIG. 3 of the vacuum cleaner of FIG. 1 wherein the cap of the blower port is removed and replaced by an end of a vacuum hose inserted into the blower port.

Referring now to the drawings, FIGS. 1 and 2 illustrate a simplified top and rear view of one example of a vacuum cleaner 10 constructed according to the teachings of the present invention. The vacuum cleaner 10 has a vacuum port 12 illustrated as having a portion of a vacuum hose 14 attached thereto. The vacuum hose 14 has a nozzle end 16 that slips into and out of the vacuum port 14 as is known to those of ordinary skill in the art. The vacuum cleaner 10 also has a blower port 18 disposed opposite the vacuum port. A removable cap assembly 20 is shown secured to the blower port 18. A motor assembly 22 is generally illustrated in FIG. 1 in top view and includes a motor housing 24 covering and protecting the motor and impeller components. FIG. 3 illustrates a partial cross section through the vacuum cleaner 10 with the cap assembly 20 installed on the blower port 18. FIG. 4 illustrates the same cross section, but with the cap assembly 20 removed from the blower port 18 and replaced by the nozzle 16 and hose assembly 14 inserted into the blower port.

As generally illustrated in FIGS. 3 and 4, the motor assembly 22 has a motor 26 supported by the motor housing 24. The motor functions as is known to those of ordinary skill in the art and will not be described in greater detail herein. The motor assembly 22 is supported by a cylindrical upstanding tank 28. The tank 28 has an open top end that is closed off by the motor housing 24 as is also known in the art. The interior of the motor housing 24 defines an air plenum or chamber of two separate plenum sections 30 and 31. The first plenum section 30 communicates with the impeller (not shown) of the motor at one end and with the second plenum section 31 at an opposite, upper end. The second plenum section 31 communicates with the blower port 18. The walls of the air plenum sections 30 and 31 direct and exhaust air drawn in by the vacuum motor back to the exterior environment of the vacuum cleaner. Air can only exit the vacuum cleaner through a plurality of vents 32 or openings provided as part of the motor housing when the cap assembly 20 is installed. Air can also exit the vacuum cleaner via both the vents 32 and the blower port 18 when the cap is removed and the blower port is left unoccupied. A hose end 16 of a hose 14 can be inserted within the blower port 18. The hose end 16 can block flow to the second plenum section 31 and to the vents 32, redirecting all air flow through the blower port 18 and hose 14 (see FIG. 4).

As shown in FIGS. 1–3, the cap assembly 20 is removably received over the blower port 18 in order to close off the port forcing air to flow to the vents 32. In one example, the blower port 18 includes a port opening or inlet 34 formed through the motor housing 24 and opening into and communicating with the first plenum section 30. For accepting the cap assembly 20, a tubular port wall 36 is received in the opening 34 and extends from the vacuum cleaner. In one example, the port wall 36 has an interior surface 38 defining an air passage therethrough, when the cap assembly 20 is not installed. A distal or outer end 39 of the port wall 36 defines a blower port outlet 40 spaced a distance from the opening 34. The blower passage is defined between the port opening 34 and the blower port outlet 39 within the annular port wall 36.

In the disclosed example, the annular port wall 36 extends outward from the port opening 34 and the motor housing 24 and cooperates with the cap assembly 20. The port wall 36 also has an exterior port wall surface 41 with one or more mechanical threads 42 extending radially outward from the surface. The mechanical threads assist in attaching the cap assembly 20, as described below.

The cap assembly 20 in this example is cylindrical and has an annular cap wall 50 with an exterior surface 52 and an interior surface 54. The disclosed interior surface 38 and exterior surface 40 of the annular port wall 36 are in the form of a circular cylinder. The interior surface 54 of the cap wall 50 is a complimentary circular cylinder that faces and cooperates with the port wall interior surface 54 when the cap is installed. An axis A is defined by the port wall 36 of the blower port 18 as shown in FIG. 3. The annular cap wall 50 is concentric with the port wall 36 and the axis A when the cap is installed. The annular cap wall has an outwardly facing or distal end 56 that faces in the direction of the vacuum cleaner exterior and has an inwardly facing or proximal end 58 that faces in the direction of the vacuum cleaner interior when installed.

The cap assembly 20 has a cylindrical hub 60 disposed concentric with the annular cap wall 50. In one example, the hub defines a proximal hub end face 62 that, when installed on the blower port 18, faces the first plenum section 30. The hub 60 has an exterior annular hub surface 64 that faces and is spaced radially inward relative to the interior surface 54 of the annular cap wall 50. A circumferential gap or 66 is defined between the exterior annular hub surface 64 and the interior cap wall surface 54, at least at those portions of the wall and hub that overlap one another. The proximal end of the gap 66 is open and the distal end of the gap terminates at a surface of a bridge 67 interconnecting the cap wall 50 and the hub 60.

In this example, the annular port wall 36 is received in the gap 66 when the cap is installed. One or more mechanical threads 68 are provided on the cap wall interior surface 54. To install the cap assembly 20, the cap is rotated such that the threads 42 engage the one or more corresponding threads 68. In one preferred example, the cap can be rotated until the port wall distal end 39 seats against a surface of the bridge 67 within the gap 66 creating an air seal between the cap assembly 20 and the port wall 36.

In the present example, the proximal hub end face 62 has a substantially smooth and slightly convex surface relative to the first plenum section 30. The smooth slightly convex surface eliminates disruptions or obstructions to the air flow path for air moving in the first plenum section 30 when the cap assembly 20 is installed. In this disclosed example, no part of the cap extends into a portion of the air plenum sections. Instead, the hub end face 62 is essentially flush with the port opening or inlet 34. Air flowing within the air plenum will travel smoothly over the hub end face 62 to further reduce noise generated by the vacuum cleaner.

In this example, the hub 60 extends essentially the entire length of the port wall 36 and air passage or interior surface 38 to fill the void between the port opening 34 and the port outlet 39. The hub end face 62 generally extends across and adjacent the port opening or inlet 34 and faces the interior plenum of the vacuum cleaner. By filling the air passage 38, the hub prevents air from entering the air passage when the blower port is closed by the cap assembly 20. This prevents turbulent flow of air within the passage and, therefore, prevents noise generated by such turbulent air flow.

The cap assembly 20 also has a distal cap end face 70 facing away from the vacuum cleaner. In the present example, the outer cap end face is provided by a discrete cap cover plate 72 having a perimeter 73 that essentially rests adjacent the cap annular wall 50.

In the present example, the hub 60 and the annular cap wall 50 are formed as an integral one-piece structure, interconnected at the bridge 67, and can be molded from a light weight plastic. The structure can be seen in FIGS. 6 and 7 wherein the cap cover plate 72 is removed. As can be seen in FIG. 6, and in FIGS. 3 and 4, a pair of open sections 76 are provided in the bridge 67 for permitting tool access to form the threads 68. The remainder of the bridge circumference 67 interconnects the hub and the annular cap wall.

In the illustrated example, the hub 60 has a deep recess 78 opposite the inner cap end face 62 and facing the outer cap end. A post 80 protrudes axially along the center axis A within the recess 78 and extends outward from an interior surface 82 of the recess. The post 80 includes a blind bore 84 that opens toward the outer end of the assembly.

As illustrated in FIGS. 3 and 4, the cap cover plate 72 has a center opening 86 for receiving a fastener 88 therein for securing the cover plate 72 to the hub 60. The fastener 88 is received through the opening 86 in the cover plate 72 and engages the blind bore 84 of the post 80 via, for example, mechanical threads. In the present example, the cap cover plate 72 also has a recessed sink portion 89 recessed into the outer cap end face 70 so that the fastener head 90 can seat flush with or beneath the end face 70.

A tether 100 is connected at one end to a portion of the cap assembly 20 and at an opposite end to a portion of the motor housing 24. The tether 100 interconnects the cap assembly 20 to the vacuum cleaner so that, even when not covering the blower port 18, the cap assembly remains attached to the vacuum cleaner. In one example, a distal end 102 of the tether is connected to a portion of the blower port 18. A proximal end 104 of the tether 100 is connected to a portion of the cap cover plate 72. In this example, the cover plate 72 is preferably molded from a plastic material wherein the tether 100 is integrally molded at the same time. When formed, the distal end 102 of the tether 100 is simply attached in any suitable manner to the vacuum cleaner for securing the cap assembly 20 to the vacuum cleaner. In this example, the distal end 102 is sandwiched or pinched between two portions of the motor housing 24. The tether can also be fastened to the housing or otherwise suitably connected to the vacuum cleaner 10.

As illustrated in FIG. 5, the exterior annual wall surface 52 of the cap 20 is also a circular cylinder except that it includes a plurality of depressions 106 or other suitable grip assist mechanism formed in the surface or received on the surface. When a user wishes to rotate the cap to install or remove the cap assembly 20, the grip assist mechanism or depressions 106 provide the user with a better grip.

As illustrated in FIGS. 6 and 7, a plurality of structural ribs 110 can be molded integrally with the hub 60 between the interior surface 82 of the recess 78 and the post 80. The structural ribs 110 provide rigidity to the cap assembly 20 and support the post 80. Use of the ribs 110 permits less material to be utilized in forming the assembly, thus reducing material waste and weight of the assembly. As will be evident to those in the art, the hub 60 can alternatively be formed as a generally solid element as well. As illustrated in FIGS. 3 and 4, the hub appears to be solid and can be formed as such. However, in the illustration of FIGS. 3 and 4, the section is actually taken through opposed structural ribs 110.

The exterior annular cap wall 52 need not be a circular cylinder as is illustrated in the drawings. The shape and configuration of the exterior annular wall can vary considerably and yet fall within the scope of the invention. The exterior shape can be tailored to accommodate a particular aesthetic design of the vacuum cleaner.

As shown in FIG. 3, the cap assembly is installed on the blower port 18. The blower port wall 36 is received in the gap 66 of the cap and rotated in one direction about the axis A. The threads 68 and 42 engage to securely hold the cap in place. The port wall distal end 39 seats against the bridge 67 to form and air seal. The hub end face 62 rests essentially flush with the port opening 34, closing off the entire air passage 38. The cap assembly 20 is rotated in an opposite direction relative to the axis A to remove the cap.

As illustrated in FIG. 4, the cap assembly 20 is removed from the blower port 18 and is suspended from the tether 100. The cap is therefore not easily lost when not installed in the blower port. Also as illustrated in FIG. 4, the cap can be replaced by a nozzle end 16 of a hose 14 that is inserted into the blower port. In one example, the nozzle end 16 can extend inward into the first plenum section 30 a sufficient distance to block or prevent air flow to the second plenum section 31. Air is thus blocked from flowing to the vents 32 and is redirected through the blower port 18. In this manner, all air flowing from the motor through the first plenum section 31 is directed to exit through the hose and thus provide maximum blower output performance.

Figure 8:
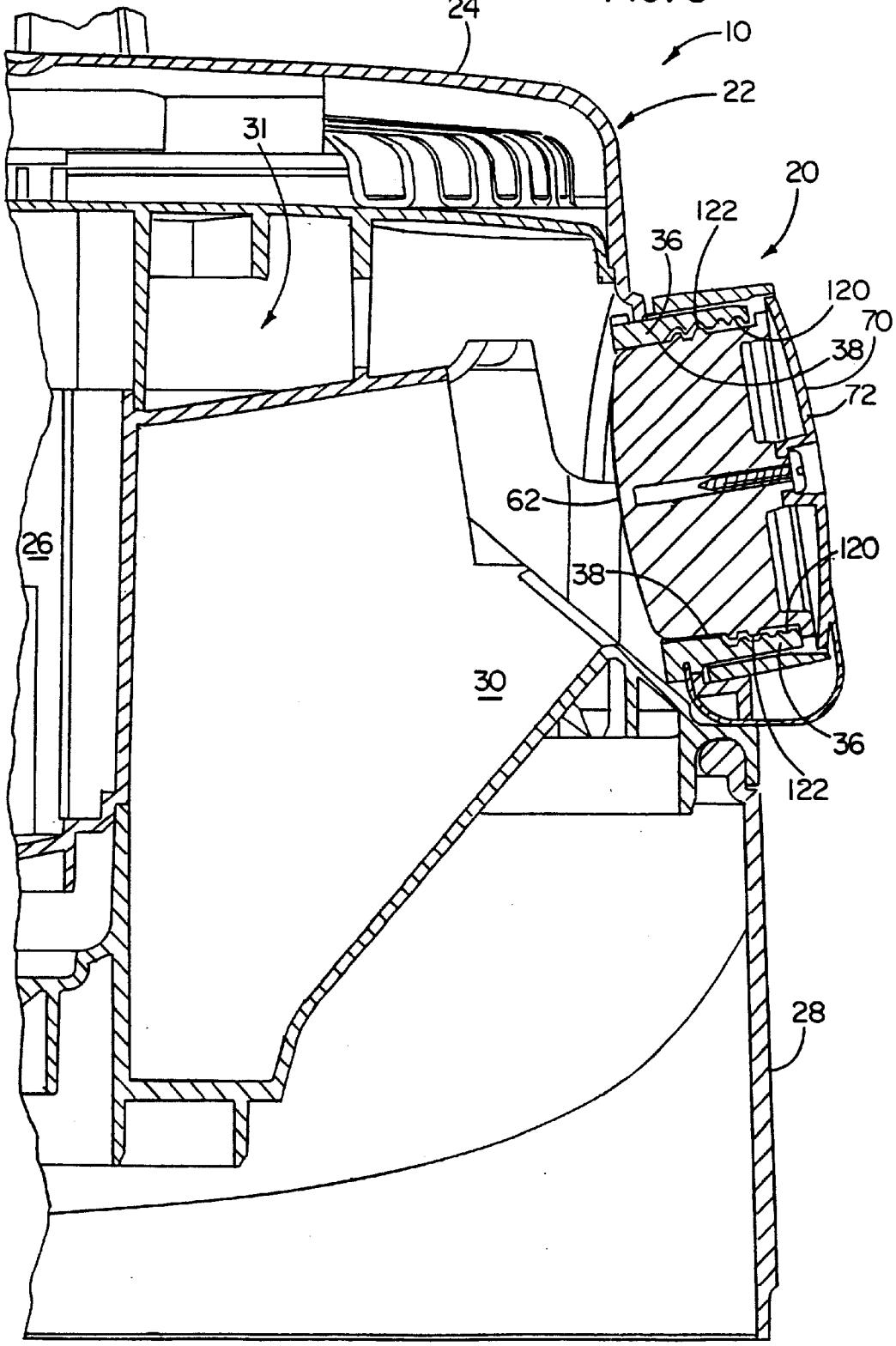
FIG. 8 is a side sectional view of the same portion as in FIG. 3 of the vacuum cleaner of FIG. 1 and including a blower port closed by an alternative example of a cap assembly of the invention.

FIG. 8 illustrates one alternative example of a cap assembly 20 that is substantially the same as that illustrated in the prior figures. The only difference here is that the interior surface or air passage 38 of the annular port wall 36 has a plurality of mechanical threads 120 that are recessed into the surface so that they do not block insertion of the nozzle end 16 into the port 34. A corresponding plurality of mechanical threads 122 are formed on the exterior hub surface 64 which cooperate with the mechanical threads 120 to install the cap assembly.

Figure 9:
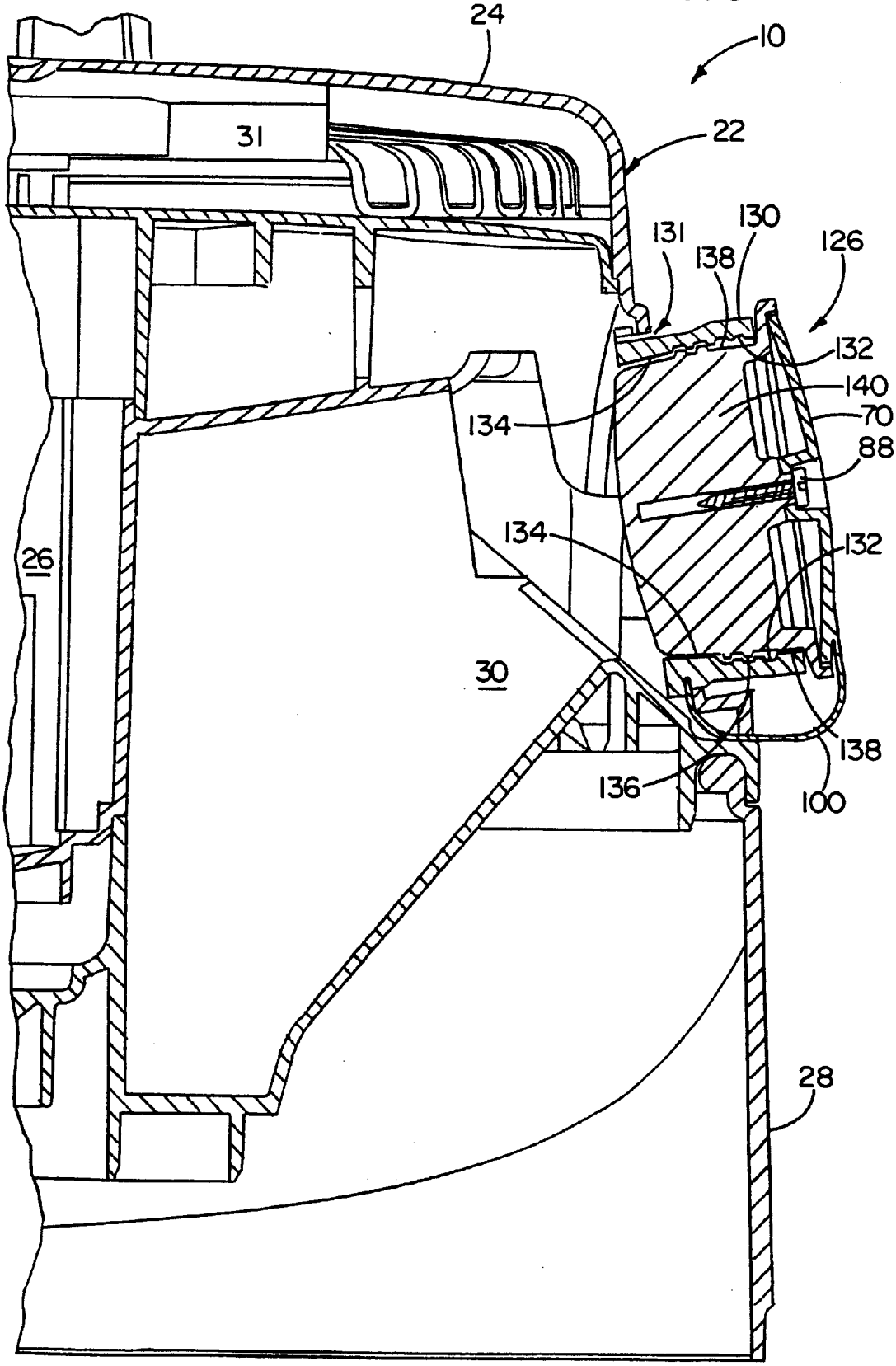
FIG. 9 is a side sectional view of the same portion as in FIG. 3 of a vacuum cleaner of FIG. 1 and including an alternative example of a blower port and cap assembly.

FIG. 9 illustrates another alternative example of a cap assembly 126 that eliminates the gap 66 between the annular cap wall 50 and the hub of the prior examples. In this example, an annular port wall 130 extends from the blower port opening 131. A plurality of mechanical threads 132 are again formed into an interior annular surface 134 of the port wall 130 and cooperate with a plurality of corresponding mechanical threads 136 formed on an exterior surface 138 of a hub 140. The hub surface 142 defining the inner cap end face is again smooth and positioned generally flush with plenum 30 interior surfaces to reduce noise generated at the blower port. This particular example of the cap assembly eliminates the gap of the prior cap examples.

As it will be evident to those skilled in the art, the hub and the annular wall of the cap can alternatively be formed as separate components or can be formed integral with one another as shown in the drawings. Also, the cap cover plate or the outer cap end surface can be formed integral with either the annular cap wall or the hub and yet fall within the scope of the present invention. Similar structural changes and modifications can be made without departing from the scope of the invention.

The foregoing detailed description has been given for clearness of understanding only, and no necessary limitations should be understood therefrom, as modifications would be obvious to those of ordinary skill in the art.

What is claimed is:

1. A convertible blower port for a vacuum cleaner, the blower port comprising:

a cylindrical port wall carried by a portion of the vacuum cleaner, the port wall having a first end facing inwardly toward the vacuum cleaner and a second end opposite the first end, the port wall defining a blower passage in communication with a plenum of the vacuum cleaner;

a blower port outlet on the second end of the port wall; and a removable cap closing off the blower port outlet and having an exterior surface for gripping the cap and having a hub configured to fill the blower passage, the hub having a substantially smooth inner end face positioned generally across the first end of the port wall and facing the plenum of the vacuum cleaner.

2. The blower port according to claim 1, further comprising:

a tether connected to the cap and a portion of the vacuum cleaner such that the cap can be secured over the blower port outlet or suspended from the tether when removed from the blower port outlet.

3. The blower port according to claim 1, wherein the port wall extends outward from the vacuum cleaner around the blower port such that the first end is connected to the vacuum cleaner and the second end and the blower port outlet are spaced from the vacuum cleaner.

4. The blower port according to claim 1, further comprising:

at least one mechanical thread on the port wall; and at least one corresponding mechanical thread on a portion of the cap for removably securing the cap to the blower port.

5. The blower port according to claim 1, wherein the cap further comprises:

an annular cap wall defining a center axis and having an exterior cap wall surface defining the exterior cap surface and having a generally cylindrical interior cap wall surface; and an exterior annular hub surface spaced radially inward from the interior annular wall surface defining a gap between the hub and the annular cap wall, wherein at least a portion of the port wall is received in the gap.

6. A convertible blower port according to claim 5, further comprising:

at least one mechanical port thread provided on an exterior surface of the port wall; and at least one corresponding mechanical cap thread provided on the interior surface of the cap wall within the gap, the port and cap threads cooperating to removably secure the cap to the blower port.

7. A convertible blower port according to claim 5, wherein the exterior surface of the annular cap wall is generally cylindrical and includes a plurality of grip assist features thereon.

8. A cap for selectively closing off a blower port of a vacuum cleaner, the cap comprising:

an annular wall defining a central cap axis and having an inwardly facing end, an outwardly facing end, an exterior wall surface and a generally cylindrical interior wall surface;

an outer cap end face that faces in the direction of the outwardly facing end of the cap wall;

a cylindrical hub disposed concentric with the cap axis and having an exterior annular hub surface spaced radially inward from the interior annular wall surface;

a substantially smooth hub end face that faces in the direction of the inwardly facing end of the cap wall; and a tether extending from a portion of the cap for attachment to the vacuum cleaner.

9. A cap according to claim 8, further comprising:

an annular gap between at least a portion of the exterior hub surface and the interior wall surface.

10. A cap according to claim 8, further comprising:

at least one mechanical thread carried on the interior wall surface for removably attaching the cap to the blower port of the vacuum cleaner.

11. A cap according to claim 8, wherein the exterior surface of the annular wall is generally cylindrical and includes a plurality of grip assist features thereon.

12. A cap according to claim 8, wherein the outer cap end face is provided on a cap cover plate removably secured to a portion of the cap.

13. A cap according to claim 8, further comprising:

a blind bore provided concentric with the cap axis and carried by a portion of the hub;

a cap cover plate having a center opening and a surface that defines the outer cap end face; and a fastener received through the cover plate opening and within the blind bore securing the cap cover plate to the cap.

14. A cap according to claim 13, wherein the hub further comprises:

an interior recess defining a concave surface within the hub facing opposite the inner cap end face;

an axial post extending from concave surface within the recess and defining the blind bore; and a plurality of ribs extending radially from the post and interconnecting the post to the concave surface of the hub, wherein the cap cover plate covers the recess when attached to the cap.

15. A cap according to claim 13, wherein the center opening in the cap cover plate includes a recessed sink portion permitting a head of the fastener to seat flush with or recessed into the outer cap end face.

16. A cap according to claim 8, wherein the outer cap end face is a separate discrete component secured to the cap.

17. A cap according to claim 8, wherein the hub and the annular wall are provided as a unitary one-piece structure.

18. A cap according to claim 17, wherein the hub and the annular wall are molded from a plastic material.

19. A cap according to claim 8, wherein one end of the tether is integrally formed as a portion of the cap.

20. A cap according to claim 19, wherein the outer cap end face is provided on a molded plastic cap cover plate removably secured to a portion of the cap and wherein the one end of the tether is integrally molded as a portion of the cap cover plate.

21. A vacuum cleaner comprising:

a tank;

a motor assembly supported by a portion of the tank and having a motor housing, a motor, and a plenum;

a blower port in communication with the motor via the plenum and having a port wall defining a blower passage, the port wall having a first end facing inward toward the vacuum cleaner and a second end facing outward away from the vacuum cleaner and defining a blower port outlet; and a removable cap closing off the blower port outlet and having an exterior surface for gripping the cap and having a hub configured to fill the blower passage, the hub having a substantially smooth inner end face positioned generally across the first end of the port wall and facing the plenum of the vacuum cleaner.

* * * * *